US006902251B2

(12) United States Patent
Morikawa et al.

(10) Patent No.: US 6,902,251 B2
(45) Date of Patent: Jun. 7, 2005

(54) INKJET PRINTING DEVICE

(75) Inventors: Jun Morikawa, Aichi-ken (JP); Masatoshi Yamada, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/225,143

(22) Filed: Aug. 22, 2002

(65) Prior Publication Data

US 2003/0038858 A1 Feb. 27, 2003

(30) Foreign Application Priority Data

Aug. 23, 2001 (JP) ..... 2001-252198

(51) Int. Cl.[7] ..... B41J 2/145; B41J 2/15
(52) U.S. Cl. ..... 347/40; 347/12; 347/41
(58) Field of Search ..... 347/12, 14, 19, 347/37, 41, 40; 101/485, 486; 358/504

(56) References Cited

U.S. PATENT DOCUMENTS

| | | | | |
|---|---|---|---|---|
| 5,059,984 A | * | 10/1991 | Moore et al. | 347/41 |
| 6,118,548 A | | 9/2000 | Ryan | 358/1.9 |
| 6,196,660 B1 | | 3/2001 | Park | 347/37 |
| 6,241,334 B1 | * | 6/2001 | Haselby | 347/19 |
| 6,439,684 B1 | * | 8/2002 | Yoshimura et al. | 347/19 |

FOREIGN PATENT DOCUMENTS

| | | | |
|---|---|---|---|
| EP | 0 566 318 A2 | 10/1993 | B41J/2/51 |
| EP | 0 630 750 A2 | 12/1994 | B41J/2/05 |
| EP | 0 665 111 A2 | 8/1995 | |
| EP | 0 879 705 A2 | 11/1998 | B41J/2/51 |
| EP | 1 048 471 A2 | 11/2000 | |
| EP | 1 070 587 A2 | 1/2001 | |
| JP | A 8-295034 | 11/1996 | B41J/2/21 |

* cited by examiner

*Primary Examiner*—Hai Pham
*Assistant Examiner*—Lam Nguyen
(74) *Attorney, Agent, or Firm*—Oliff & Berridge, PLC

(57) ABSTRACT

A printing device includes a sheet feeding mechanism that feeds the recording sheet by a predetermined amount at a time, a carriage that is movable, substantially at a constant speed, in a direction substantially perpendicular to a sheet feeding direction, and a print head mounted on the carriage. The print head is capable of simultaneously forming a plurality of print lines when the carriage moves. The print head is controlled to print a first print pattern that is formed by part of the plurality of print lines on an upstream side. The recording sheet is fed by the predetermined amount after the first pattern is formed. Thereafter, a second print pattern that is formed by part of the plurality of print lines on a downstream side after the recording sheet is fed. At least a part of the first print pattern overlaps a part of the second print pattern.

26 Claims, 13 Drawing Sheets

INKJET PRINTING DEVICE

BACKGROUND OF THE INVENTION

The present invention relates to an inkjet printing device, and a method for controlling the inkjet printing device.

An inkjet printing device is typically provided with a movable carriage mounting a print head, which is provided with arrays of nozzles. The carriage is movable in a direction substantially perpendicular to a sheet feeding direction, and the nozzle arrays extend in the sheet feeding direction. The inkjet printing device is typically controlled such that the sheet and the carriage are alternately driven to move, and the printing head (i.e., the nozzle arrays) is controlled to eject ink to the sheet when the carriage moves, in accordance with print data. Such a printing method is well known as an interlace printing method.

Various improvements for accelerating a printing speed, improving quality of printed image, and the like have been suggested. In an example, in order to accelerate the printing speed, the nozzles arrays are elongated in the sheet feed direction to increase a width of an area where an image is printed by one printing movement of the carriage.

Recently, in order to provide high-quality images, glossy paper is often used as the recording sheet. The glossy paper is not impregnated with ink well and accordingly, black ink does not dry well on the glossy paper. Therefore, when a black image is to be printed on the glossy paper, a printing operation is performed in a color-mixing printing mode, where the color inks other than the black ink, (e.g., cyan, yellow and magenta inks) are overlaid to form a black image.

Even with the above control, image quality will not be improved sufficiently. For example, if the array of nozzles are elongated to accelerate the printing speed, an inclination of the array with respect to the sheet feed direction affect the image quality. In the printing device employing the interlace method, a printed line formed by a nozzle located at one end of the array, and a printed line formed by a nozzle located at the other end of the array should be overlapped. If the nozzle array is inclined with respect to the sheet feed direction, the two printed line formed by the upstream side end nozzle and the downstream side end nozzle may slightly shift with respect to each other in the carriage movement direction, which deteriorates the image quality.

Further, when the printing device performs bi-direction printing operation in the color-mixing mode, control described below is performed.

When the carriage moves in one direction, cyan, yellow and magenta images are printed in this order to form a black image, while when the carriage moves in the opposite direction, magenta, yell and cyan images are printed in this order. Depending on the direction where the carriage moves, the color tone of the black image is slightly different. That is, if the black image is formed with the bi-directional movement of the carriage in the color-mixing mode, the color tone of the entire image becomes uneven. Therefore, when the printing operation is performed in the color-mixing mode, the one-directional movement of the carriage is generally employed.

It should be noted that when the printing operation is performed in the color-mixing mode with the one-directional movement of carriage, since the three color images are formed exactly on the same position on the recording sheet, a higher accuracy in controlling the movement of the carriage is required.

In particular, if the printing operation is performed in the color-mixing mode with the one-directional movement of carriage and if the array of the nozzles is inclined with respect to the sheet feeding direction, an image formed by an upstream side nozzles and an image formed by the downstream side nozzles do not match and the quality of the resultant image becomes relatively low. In order to avoid such a problem, accuracy of parts and assembling accuracy have been improved until the blurred condition as described above becomes inconspicuous. However, due to recent requirement of elongating the array of nozzles, it becomes difficult to achieve the sufficient accuracy in the conventional printing device.

SUMMARY OF THE INVENTION

The present invention is advantageous in that the image quality can be readily improved in the above-described type printing device. The present invention also provides a method of controlling such a printing device.

In an embodiment, there is provided a printing device that prints an image on a recording sheet, including a sheet feeding mechanism that feeds the recording sheet by a predetermined amount at a time, a carriage that is movable, substantially at a constant speed, in a direction substantially perpendicular to a sheet feeding direction, a print head mounted on the carriage, the print head capable of simultaneously forming a plurality of print lines when the carriage moves, and a controller that controls operations of the sheet feeding mechanism, the carriage and the print head. The controller controls the carriage and the print head to print a first print pattern that is formed by a part of the plurality of print lines which are on an upstream side with respect to the sheet feed direction. Then, the controller controls the sheet feeding mechanism to feed the recording sheet after the first pattern is formed. The controller controls the carriage and the print head to print a second print pattern that is formed by a part of the plurality of print lines which are on a downstream side with respect to the sheet feed direction after the recording sheet is fed by the predetermined amount. It should be noted that at least a part of the first print pattern overlapping a part of the second print pattern.

With this configuration, by examining the overlapping (or shifting) condition of the printed patterns, on the overlapping condition, adjustment can be applied.

Optionally, the printing device may further include a position changing system that is capable of changing a positional relationship between the first pattern and the second pattern.

With use of the position changing system, the shifting condition can be corrected so that the first and second patterns coincide with each other in a direction where the carriage moves.

In one case, the position changing system mechanically changes the positional relationship between the first pattern and the second pattern. For example, a mechanism that changes the inclination of the print head may be provided to the printing device, and by operating the mechanism, the shifting condition of the first and second patterns can be corrected. Alternatively, the position changing system may electrically change the positional relationship between the first pattern and the second pattern. In this case, by shifting an image forming timing of each print line, the first and second patterns can be aligned in the carriage movement direction.

In a particular case, moving directions of the carriage when the first pattern and second pattern are formed are the same. That is, the controller may controls the print head such that the inks are ejected only when the carriage moves in a predetermined direction, and that the inks are not ejected when the carriage moves in an opposite direction. It is sometimes necessary to form an image only when the carriage moves in one direction. Therefore, it may be preferable that the overlapped condition of the first and second patterns is examined and corrected under the same printing condition.

Alternatively, the moving directions of the carriage when the first pattern and second pattern are formed are opposite. When a normal color image is formed, the inks are ejected when the carriage moves in either direction. In such a case, it may be preferable that the overlapped condition of the first and second patterns is examined and corrected under the same printing condition.

The embodiment according to the invention further provides an inkjet printer that prints an image on a recording sheet, which printer is provided with a sheet feeding mechanism that feeds the recording sheet by a predetermined amount at a time, a carriage that is movable, substantially at a constant speed, in a direction substantially perpendicular to a sheet feeding direction, a print head mounted on the carriage, the print head having a plurality of arrays of ink ejecting nozzles, each of the plurality of arrays extending in a direction substantially parallel with a sheet feeding direction, and a controller that controls operations of the sheet feeding mechanism, the carriage and the print head. The controller controls the carriage and the print head to print a first print pattern using upstream ones of each of the arrays of ink ejecting nozzles. Then, the controller controls the sheet feeding mechanism to feed the recording sheet. The controller controls the carriage and the print head to print a second print pattern using a downstream side ones of each of the arrays of ink ejecting nozzles, at least a part of the first print pattern overlaps a part of the second print pattern.

With this configuration, by examining the overlapping (or shifting) condition of the printed patterns, an inclination of the nozzle arrays can be detected. Then, based on the overlapping condition, the inclination can be compensated for.

Optionally, the inkjet printer may include a mechanism that changes an inclination of the nozzle arrays with respect to the sheet feed direction.

The embodiment according to the invention further provides a multi-line color printer that prints an image on a recording sheet in accordance with an interlace printing method. The printer provides a sheet feeding mechanism that feeds the recording sheet by a predetermined amount at a time, a carriage that is movable, substantially at a constant speed, in a direction substantially perpendicular to a sheet feeding direction, a print head mounted on the carriage, the print head capable of simultaneously forming a plurality of print lines when the carriage moves, and a controller that controls the print head to form a color image with the plurality of print lines in a first operation mode, the controller forming a black and white image with predetermined part of print lines in a second operation mode.

With this configuration, when operated in the first operation mode, the entire print lines are used to quickly form a color image. Further, when operated in the second mode, a high quality image can be formed.

The first operation mode may be a color print mode in which all of color inks provided to the print head are used. The second operation mode is a color-mixing print mode in which a black and white image is formed by overlaying color inks without using a black ink. Typically, the color inks include cyan, yellow and magenta inks.

Optionally, the print head is provided with a plurality of arrays of ink ejecting nozzles extending in a sheet feeding direction, each of the plurality of arrays of ink ejecting nozzles divided into a plurality of blocks, nozzles of in a same block being formed at a time, nozzles included in one of the plurality of blocks being driven in the second operation mode.

Since it is ensured that the nozzles within the same block is exactly aligned along a line, by using the nozzles within a single block, a high quality image can be formed.

Optionally, an image is formed when the carriage moves in both direction in the first operation mode, and an image is formed only when the carriage moves in a predetermined one direction in the second operation mode.

The embodiment according to the present invention further provides a method of examining an image quality of a printing device that prints an image on a recording sheet, the printing device including a sheet feeding mechanism that feeds the recording sheet by a predetermined amount at a time, a carriage that is movable, substantially at a constant speed, in a direction substantially perpendicular to a sheet feeding direction, a print head mounted on the carriage, the print head capable of forming a plurality of print line when the carriage moves. The method includes printing a first print pattern that is formed by a part of the plurality of print lines which are on an upstream side with respect to the sheet feed direction, feeding the recording sheet after the first pattern is formed, and printing a second print pattern that is formed by a part of the plurality of print lines which are on a downstream side with respect to the sheet feed direction after the recording sheet is fed by the predetermined amount, at least a part of the first print pattern overlaps a part of the second print pattern.

According to the method, it becomes possible to examine an inclination of the print head with respect to the sheet feed direction.

The method may be stored in a memory device such as a ROM in a form of a program executed by a CPU of the printing device.

The embodiment according to the invention further provides a method of forming an image with a multi-line color printer that prints an image on a recording sheet in accordance with an interlace printing method, the printer including a sheet feeding mechanism that feeds the recording sheet by a predetermined amount at a time, a carriage that is movable, substantially at a constant speed, in a direction substantially perpendicular to a sheet feeding direction, a print head mounted on the carriage, the print head capable of simultaneously forming a plurality of print lines when the carriage moves. The method includes forming a color image with the plurality of print lines in a color print mode in which all of color inks provided to the print head are used, and forming a black and white image with predetermined part of print lines in a color-mixing print mode in which a black and white image is formed by overlaying color inks without using a black ink.

The method may also be stored in a memory device such as a ROM in a form of a program executed by a CPU of the printing device.

BRIEF DESCRIPTION OF THE ACCOMPANYING DRAWINGS

DETAILED DESCRIPTION OF THE EMBODIMENT

Hereinafter, an exemplary embodiment of the invention will be described with reference to the accompanying drawings.

Figure 1:
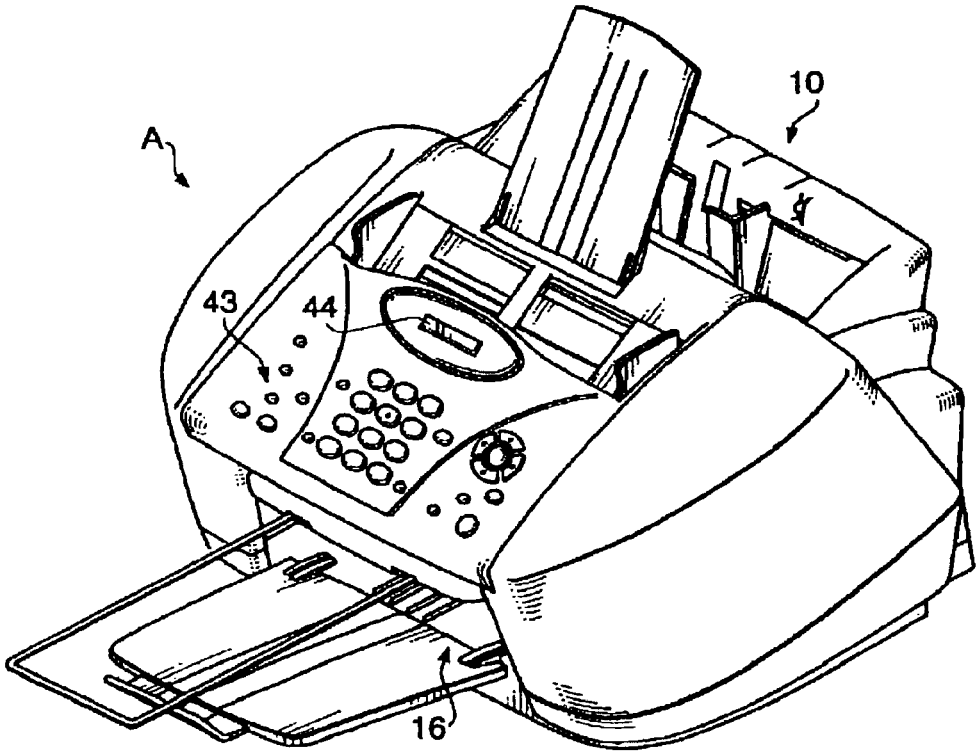
FIG. 1 shows a perspective view of a facsimile apparatus employing a printing device according to an embodiment of the invention.
Figure 2:
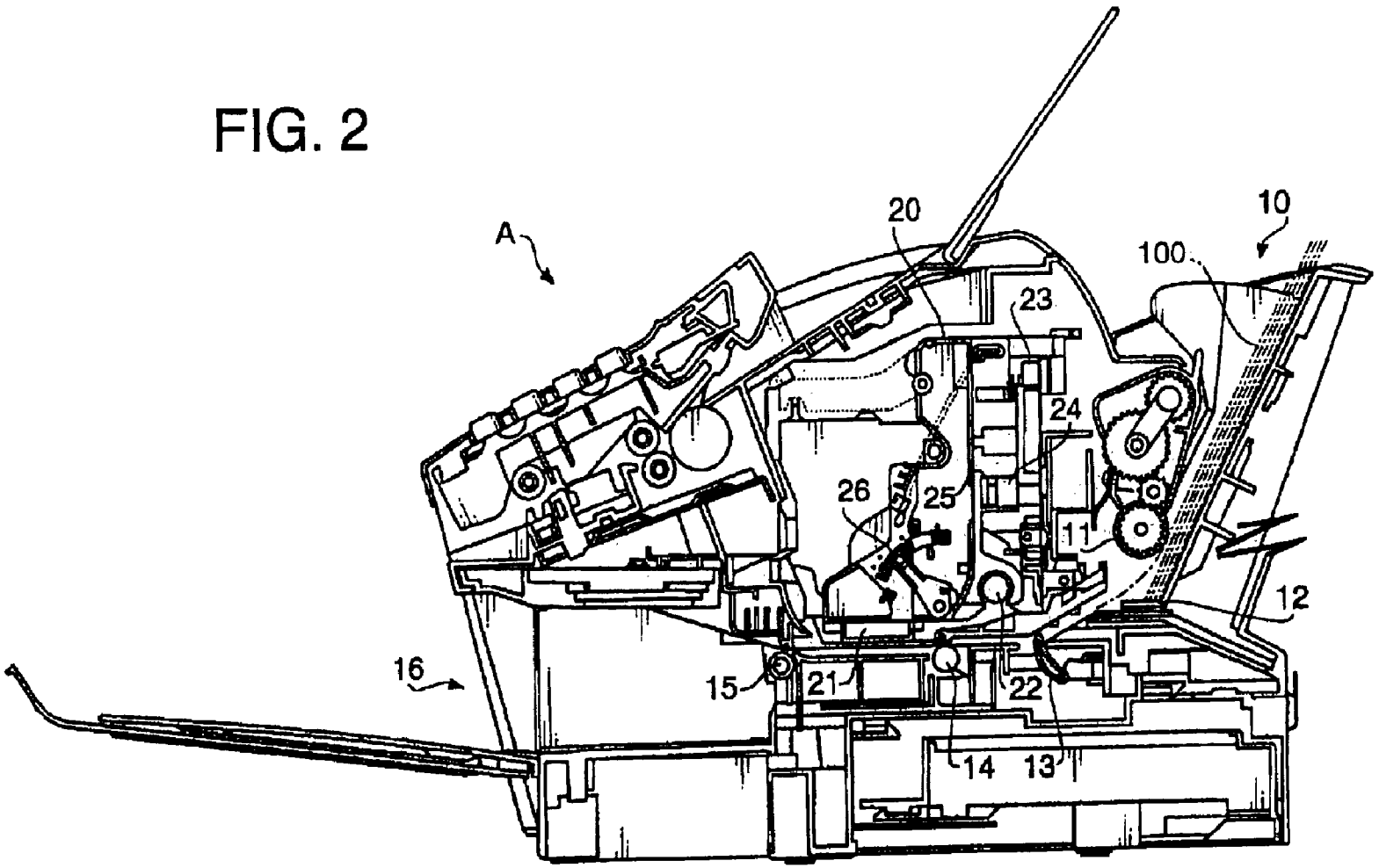
FIG. 2 is a cross-sectional view of the facsimile apparatus schematically showing an inner structure thereof.

FIG. 1 shows a perspective view of a facsimile apparatus 100 employing a printing device according to an embodiment of the invention. FIG. 2 is a cross-sectional view of the facsimile apparatus 100 schematically showing an inner structure thereof. The facsimile apparatus 100 includes a printing device employing an inkjet printing method (hereinafter, referred to as an inkjet printer), an image reading device (hereinafter, referred as a scanner), a transmitting device and the like.

The facsimile apparatus 100 is configured such that, when connected to a personal computer of the like, the facsimile apparatus 100 functions as the inkjet printer and/or scanner. Further, the facsimile apparatus 100 functions as a copier since an image can be read using the scanner, and the scanned image is printed using the printer. In the description hereafter, since the scanner and/or transmission function are not essential in view of the present invention, description thereof is simplified. While, the invention mainly relates to the inkjet printer, which will be described in detail. It should be noted that, although the inkjet printer implemented with the facsimile apparatus 100 is described; the invention is not limited to such a configuration and is applicable to various types of inkjet printers.

The inkjet printer includes a sheet feeding mechanism and a printing mechanism.

The sheet feeding mechanism includes a sheet holding unit 10, a sheet supply roller 11, a sheet separator 12, a sheet sensor 13, a main roller 14, a discharge roller 15, a sheet discharge unit 16, which are arranged, from an upstream side to a downstream side, along a sheet feed direction. In addition to the above, the sheet feeding mechanism is provided with motors for driving the rollers 11, 14 and 15.

The printing mechanism includes a carriage 20 which reciprocally moves in a direction substantially perpendicular to a sheet feed direction, a print head 21 mounted on the carriage 20, a shaft 22 which slidablly mounts the carriage 20, a guide frame 23 for guiding the movement of the carriage 20, a linear encoder 24 and an slit plate 25 formed with a plurality of encoder slits for generating, in association with the encoder 24, a pulse signal representative of the carriage position 20. Further to the above, the printing mechanism is further provided with a DC motor for driving the carriage 20 to move, ink tanks mounted on the carriage 20, which are not shown in the drawings.

On the sheet holding unit 10, a plurality of cut sheets 100 are placed in a stacked state, with a leading end of each sheet contacting the sheet separator 12. The surface of the sheet separator 12 to which the leading ends of the sheets 100 are abut is formed to be a rough surface having a relatively high frictional coefficient. When the sheet supply roller 11 is rotated clockwise in FIG. 2, one cut sheet which contacts the sheet supply roller 11 is separated from the stack of the cut sheets 100 contacting the sheet separator 12 and fed forward in the sheet feed path. As the cut sheet is fed, the leading end thereof comes into contact with the sheet sensor 13, thereby a position of the sheet being detected. The sheet is further fed by a predetermined amount after the leading end is detected by the sheet sensor 13, thereby the leading end portion of the sheet reaches the main roller 14. The sheet is further fed until it is located between the main roller 14 and the discharge roller 15, at this stage, the sheet feeding operation is paused.

After the above-described sheet set procedure is finished, the printing operation is performed using the print head 21. As will be described later, In the embodiment, the carriage 20 moves in the direction substantially perpendicular to the sheet feed direction. While the carriage 20 moves, the print head 21 is controlled to eject inks to form an image on the sheet. It should be noted that an image area formed by one-way movement of the print head 21 (which will be referred to an image segment, hereinafter) extends in the direction parallel to the direction where the carriage 20 moves, and has a predetermined width in the sheet feed direction. The image segment includes a plurality of print lines. After the image segment is formed on the sheet, the sheet is fed forward by an amount corresponding to the width of the image segment. The feeding amount is less than the width of the image segment so that at least one print line of an image segment overlaps that of the previous image segment. The printing and sheet feeding operations are alternately performed to form an entire image (i.e., all the image segments) on the sheet. When the trailing end of the sheet reaches a predetermined position, a sheet discharging operation is started. During the sheet discharging operation, the sheet, on which the image has been formed, is completely discharged via the discharge roller 15 to the discharge unit 16.

The carriage 20 reciprocates in the direction substantially perpendicular to a plane of FIG. 2. During the movement of the carriage 20, inks are ejected from the print head 21 to form an image (i.e., image segment) on the sheet. As aforementioned, there are two types of printing method: one-directional printing; and bi-directional printing.

In the one-directional printing, the ink is ejected from the print head 21 only when the carriage 20 moves in a predetermined direction. When the carriage 20 moves in the opposite direction, printing is not performed. In the bi-directional printing, the inks are ejected from the print head 21 in each time when the carriage 20 moves.

It should be note that, when an image (i.e., image segment) is formed, the carriage 20 moves at a constant speed, and the sheet is temporarily stopped. Due to this configuration, the sheet is normally fed between the reciprocal movements of the carriage 20, i.e., when the carriage 20 changes its moving direction. The position of the carriage 20 is detected with the linear encoder 24 and the slit plate 25. That is, the slit plate 25 is an elongated plate member extending in a direction parallel to the moving direction of the carriage 20, and a plurality of slits are formed along its extending direction. The encoder 24 is, for example, a light-reflective type encoder integrally provided with the carriage 20, and moves together with the carriage 20. As the carriage 20 moves, the encoder 24 optically detects the plurality of slits one by one. By counting the number of detected slits, the current position of the carriage 20 can be identified.

Figure 3:
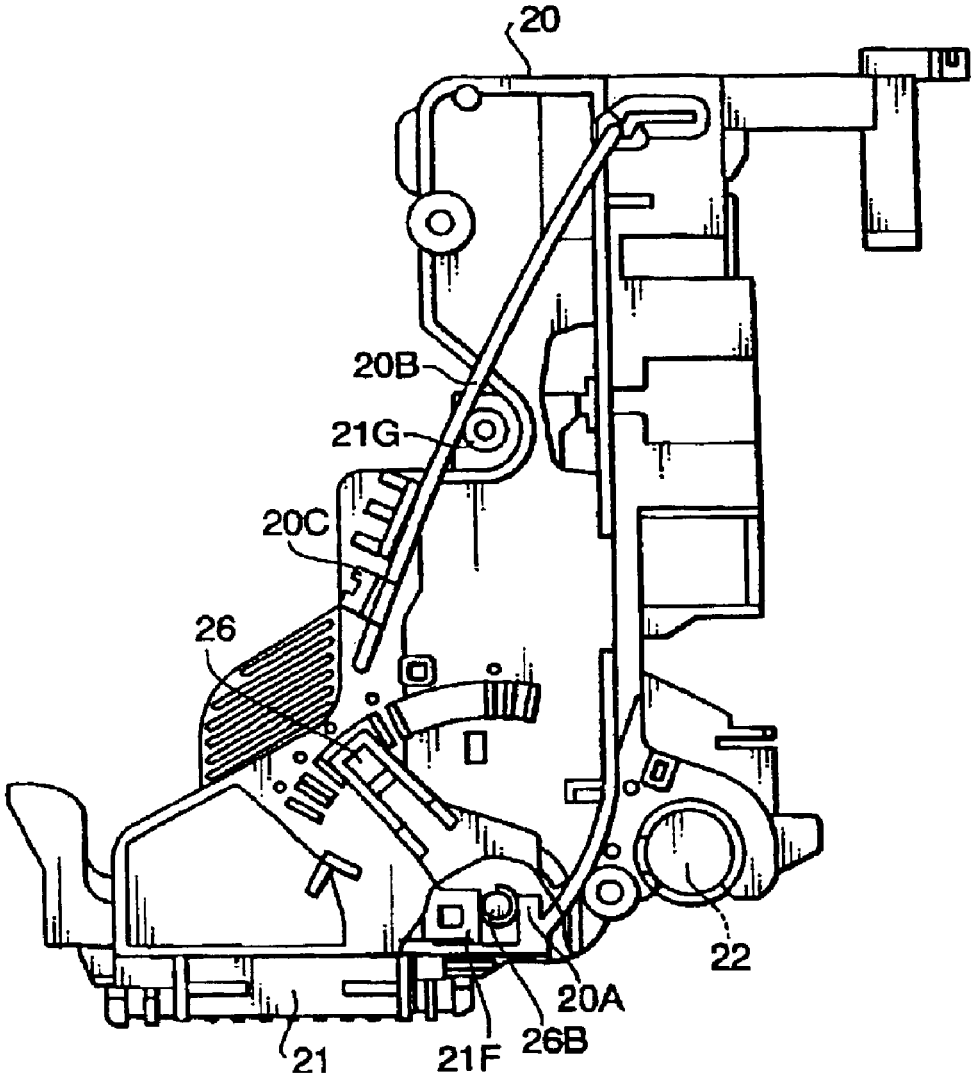
FIG. 3 is a side view of a carriage of the printing device with a portion being broken away for clarity.
Figure 4:
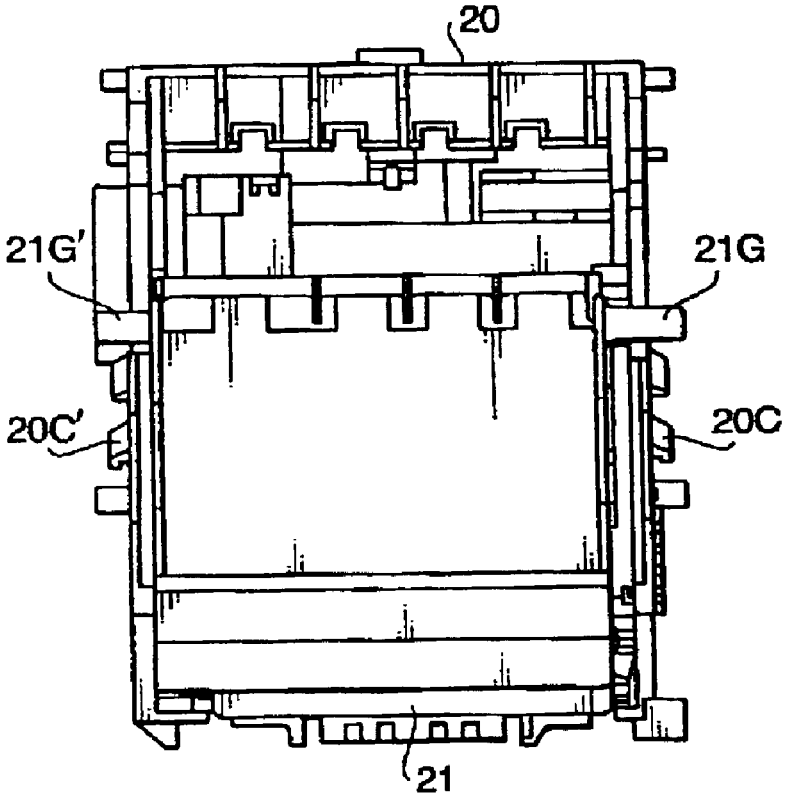
FIG. 4 is a front view of the carriage.
Figure 5:
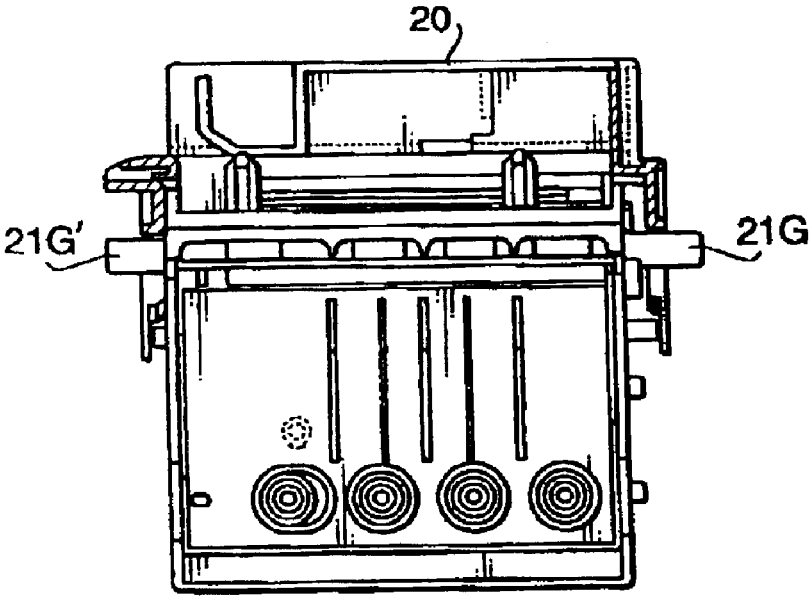
FIG. 5 is a top view of the carriage.
Figure 6A:
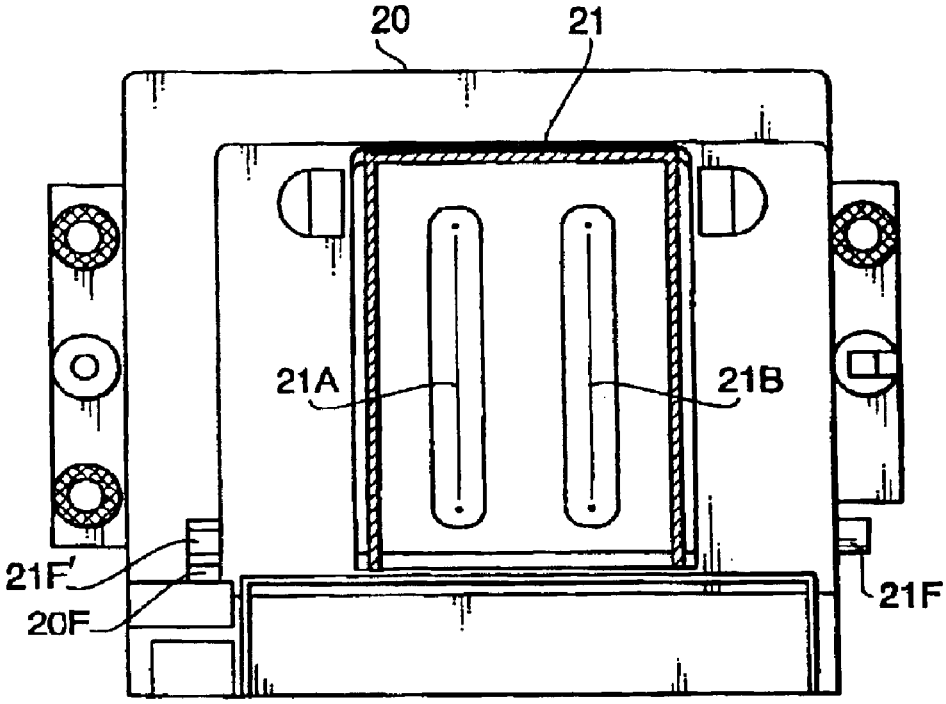
FIG. 6A is a bottom view of the carriage showing a print head mounted thereon.

FIGS. 3 through 5 are side view, front view and top view of the carriage 20. FIG. 6A is a bottom view of the carriage 20 showing the print head 21.

Figure 6B:
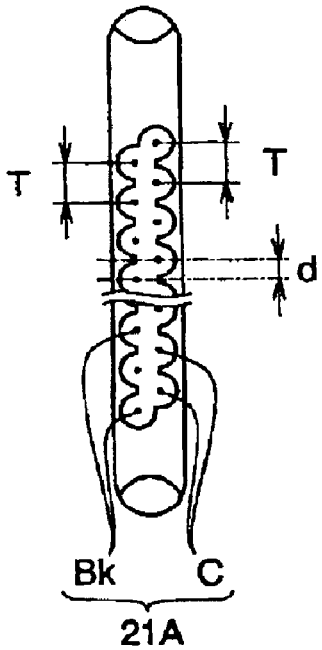
FIGS. 6B and 6C show nozzle arrays provided in the print head.
Figure 6C:
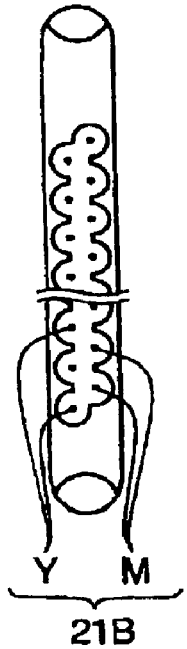

As shown in FIG. 6A, the print head 21 is coupled to the carriage 20 with a bottom surface being exposed to outside. To the bottom surface of the print head 21, two arrays 21A and 21B of nozzles for ejecting inks are provided. The nozzles are configured such that the inks from ink tanks are ejected with use of piezoelectric elements. This type of nozzles are well known, and will not be described in detail herein. In this embodiment, although not shown, there are four ink tanks for black, cyan, yellow and magenta inks, respectively. Specifically, the black and cyan inks are ejected through the nozzle array 21A, and the yellow and magenta inks are ejected through the nozzle array 21B. As show in FIGS. 6B and 6C, each of the nozzles Bk, C, Y and M for black, cyan, yellow and magenta inks are arranged in a line such that the plurality of nozzles for the same color are aligned in a direction parallel with the sheet feeding direction at intervals of T. in the nozzle array 21A, the nozzles Bk for the black ink and the nozzles C for the cyan ink are spaced in the direction where the carriage 20 moves, and shifted in the sheet feed direction by an amount of d, which is a half of the interval T. In this embodiment, T is approximately 1/75 inches, and d is approximately 1/150 inches. The array 21B has the similar structure for yellow and magenta inks. It should be noted that the number of the nozzles in one line (i.e., for one color ink) is relatively great with respect to a conventional print head, and is, for example, 75. With such a configuration, the width of the image segment (i.e., a length in the sheet feed direction of the image segment) is relatively large, which accelerates the printing speed since an image can be formed within a larger area at a time.

As aforementioned, for the accuracy of the image formation, the nozzles of each line must be aligned along a direction parallel with the sheet feed direction.

In the embodiment, a structure for adjusting the alignment of the nozzle arrays is provided. As shown in FIG. 3, on a side surface of the carriage 20, an adjustment lever 26 is provided. By manually operating the adjustment lever 26, the orientation of the print head 21 with respect to the carriage 20 can be changed so that the each line of nozzles are aligned along the sheet feed direction exactly. In this embodiment, five adjustment positions are provided. By locating the adjustment lever 26 at appropriate one of the five adjustment positions, the nozzles are aligned substantially parallel with the sheet feeding direction.

As shown in FIG. 3, the carriage 20 has a rod-shaped elastic member 20B at each side thereof. One end of the rod-shaped elastic member is secured at the top portion of the carriage, and the other end is hooked in a hook member 20C formed on the side surface of the carriage 20. The print head 21 is formed with protrusions 21G and 21G' on both sides thereof (see FIGS. 4 and 5). which are press-contacted with the elastic members 20B on both sides. Therefore, the protrusions 21G and 21G' are pressed by the elastic members 20B and 20B. respectively, so that the print head 21 is biased to have a fixed positional relationship with respect to the carriage 20. In FIG. 3, the print head 21 is biased in the lower-right direction.

The print head 21 is provided with a protrusion 21F. As will be described in detail, the lever has an eclipse cam 26B, which is integrally formed with the lever 26. The carriage 20 has a contacting member 20A. As shown in FIG. 3, and will be described with reference to FIGS. 9A-9E, the cam 26B is located between the protrusion 21F and the contacting member 20A. When the lever 26 is rotated, due to a profile of the cam 26B, the protrusion 21F formed on the print head 21 moves away from the contacting member 20A against the biasing force cased between the elastic member 20B and the protrusions 21G and 21G', or approaches the protrusion 21F. As shown in FIG. 6A. a portion of the print head 20 opposite to the protrusion 21F has another protrusion 21F' which is biased to contact a portion 20F formed at a corresponding position of the carriage 20. Accordingly, by rotating the lever 26, one side of the print head 21 can be moved with respect to the carriage 20, thereby the inclination of the arrays 21A and 21B of the nozzles can be varied.

In a normal print mode, the inks are ejected from the nozzle arrays 21A and 22B when the carriage 20 moves, and thereafter, the sheet is fed by an amount less than the length of the nozzle arrays 21A and 21B. After the sheet is fed, the carriage 20 is moved again and the inks are ejected to form further images. With this movement, a currently formed image segment partially overlaps the previously form image segment. By repeating the above control, which is known as the interlace printing method, an image is formed on the entire sheet.

In the embodiment, the length of the nozzle arrays 21A and 21B are relatively long. It is preferable that the nozzles of each array are exactly aligned in the sheet feed direction. If there is a slight inclination between the line on which the nozzles are aligned and the sheet feed direction, the overlapped portion includes positional error in the direction where the carriage 20 moves. Therefore, before the product (i.e., the facsimile apparatus 100) is shipped, a predetermined test pattern is printed with the inkjet printing device, to examine whether the pattern is correctly printed. and based on the printed result, the inclination of the nozzle arrays 21A and 21B is adjusted by operating the adjustment lever 26.

Figure 7A:
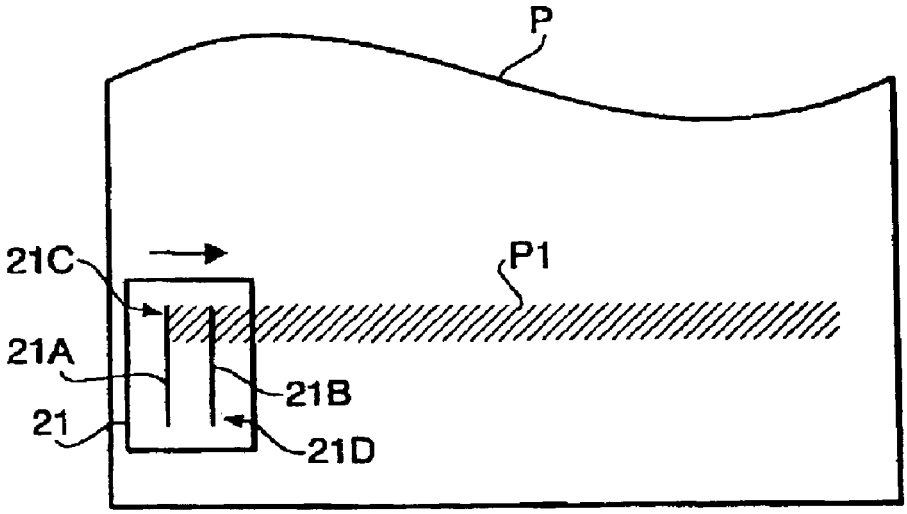
FIGS. 7A and 7B illustrates printing patterns.
Figure 7B:
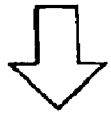
Figure 7B:
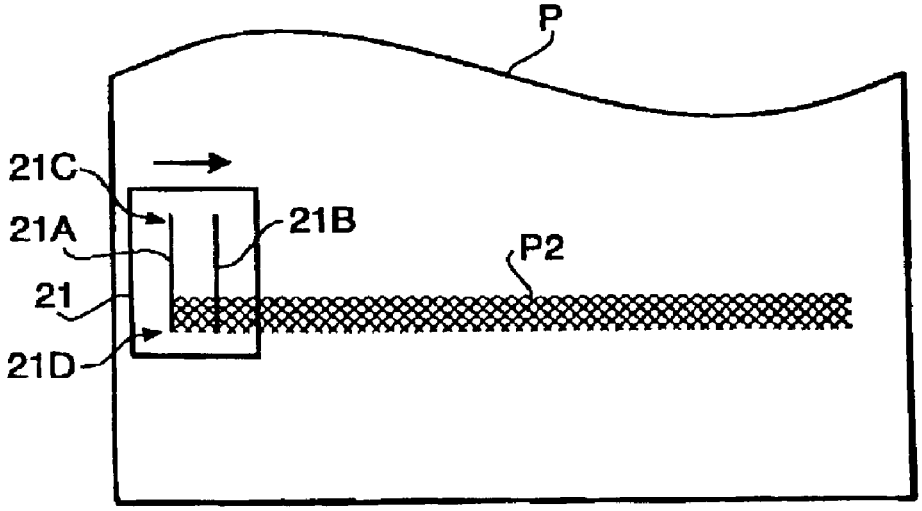
Figure 8A:
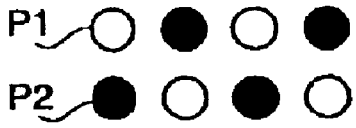
FIGS. 8A and 8B illustrate shift of patterns.
Figure 8B:
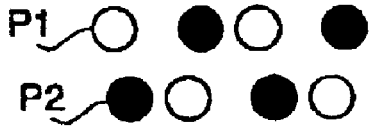

FIGS. 7A and 7B illustrate formation of the test pattern, and FIGS. 8A and 8B illustrate printed results in normal and inclined condition, respectively.

When the test pattern is printed on a sheet P, as shown in FIG. 7A, a downstream side portion 21C of the nozzle arrays 21A and 21B are driven to form a first pattern P1. Then, the sheet P is fed until the printed pattern P1 reaches the upstream side portion 21D of the nozzle arrays 21A and 21B. The upstream side portion 21D is then driven to form a pattern P2. With this control, it becomes possible to visually evaluate whether the two patterns formed by the portions 21C and 21D are shifted with respect to each other in the carriage movement direction (i.e., whether the nozzle arrays 21A and 21B are inclined with respect to the sheet feed direction). It should be noted that the first and second patterns may be formed when the carriage 20 is moved in one predetermined direction. Alternatively, the first and second patterns may be formed when the carriage 20 moves in opposite directions.

If two patterns are shifted due to the inclination of the arrays with respect to the sheet feed direction, they are observed to shift in the direction where the carriage 20 moves.

FIGS. 8A and 8B schematically shows the overlapped portion of the patterns formed by the nozzles 21C and 21D. When the two patterns are not shifted, the first pattern P1 represented by block dots and the second pattern P2 represented by white dots are arranged evenly as shown in FIG. 8A. If the arrays 21A and 21B are inclined with respect to the sheet feed direction, the first and second pattern P1 and P2 are shifted and therefore, the black dots and white dots are not evenly arranged, as shown in FIG. 8B.

When the two patterns P1 and P2 are shifted, the position of the print head 21 is adjusted as follows.

Figure 9A:
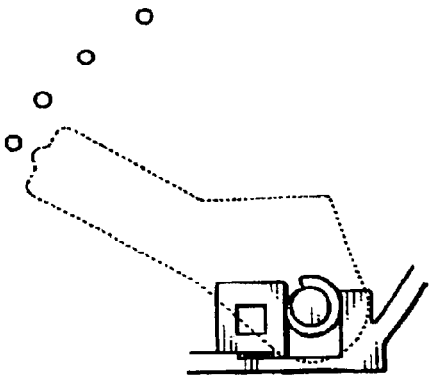
FIGS. 9A through 9E illustrate positions of a lever for adjusting an orientation of the printing head.
Figure 9B:
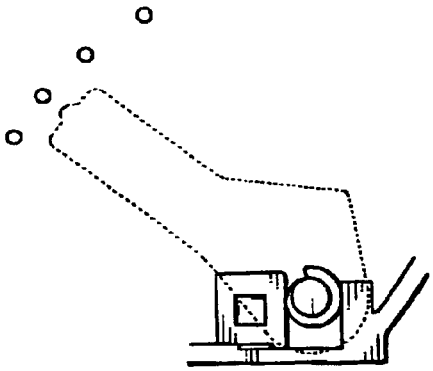
Figure 9C:
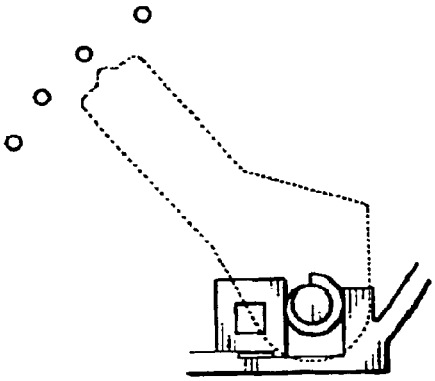
Figure 9D:
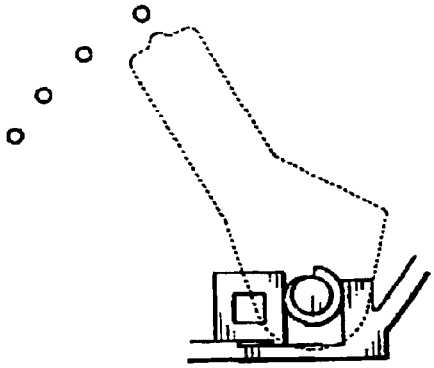
Figure 9E:
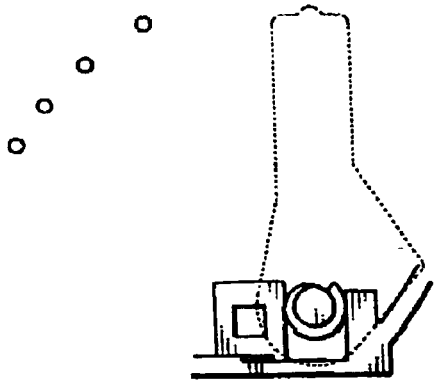

First, as shown in FIG. 9A, the adjustment lever 26 is located at one of the positions. FIGS. 9B through 9E show other adjustable positions of the lever 26 (which is indicated by broken lines) and orientation of the cam 26B, respectively. It should be noted that the positions of the lever 26 in FIGS. 9A–9E correspond to the five positions indicated by five dots along arc-like area corresponding to a movable area of the tip portion of the lever 26 shown in FIG. 2.

A supporting shaft 26A of the adjustment lever 26 is provided with, as described above, the eccentric cam surface 26B. Along the circumferential direction, half the profile of the cam 26 is formed to have a fixed radius, while the other half has a radius-varying profile. As shown in FIGS. 9A–9E, depending on the orientation of the lever 26, a position of the protrusion 21F with respect to the contacting portion 20A varies. Specifically, when the lever 26 is rotated clockwise, a distance between the protrusion 21F and the contacting portion 20A increases. With this configuration, by appropriately locating the adjustment lever 26, the nozzle arrays 21A and 21B are aligned substantially perpendicular to the sheet feed direction.

Figure 10:
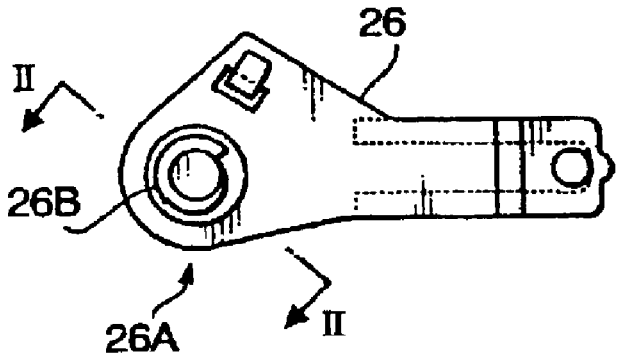
FIG. 10 show a back side of an adjustment lever.
Figure 11:
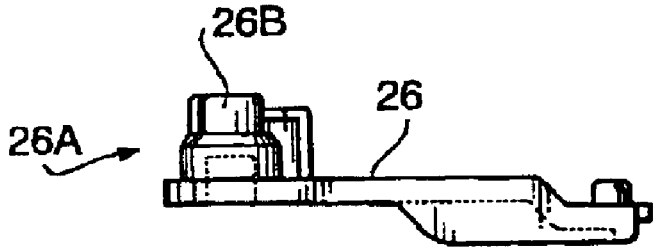
FIG. 11 is a bottom view of the adjustment lever.
Figure 12:
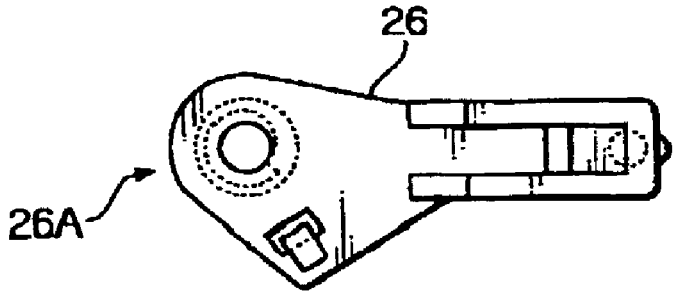
FIG. 12 shows a front surface of the adjustment lever.
Figure 13:
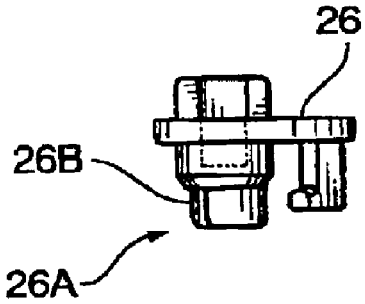
FIG. 13 is a side view of the adjustment lever.
Figure 14:
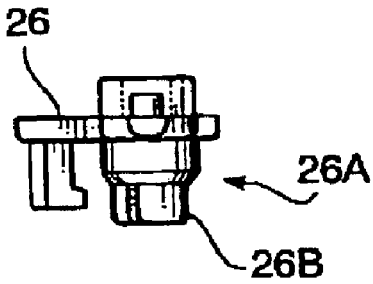
FIG. 14 is a side view of the adjustment lever.
Figure 15:
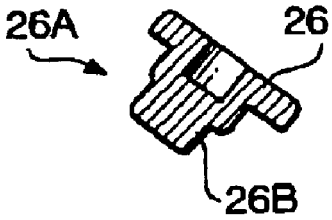
FIG. 15 is a cross-sectional view taken along line II—II in FIG. 10.

FIGS. 10–15 show the adjustment lever 26 at various angles. FIG. 10 show a back side of the adjustment lever 26 showing the shaft 26A on which the lever 26 is integrally secured, and the cam 26B which integrally formed on the shaft 26A. FIG. 11 is a bottom view of the adjustment lever 26. FIG. 12. shows a front surface of the adjustment lever 26B, and FIG. 13 is a side view of the adjustment lever 26. FIG. 14 is a side view of the adjustment lever 26, and FIG. 15 is a cross-sectional view taken along line II—II in FIG. 10.

According to the embodiment, when the glossy paper is used, the color-mixing print mode is used, since the black ink does not dry quickly on the glossy paper. In the color-mixing print mode, a black image is formed by mixing the cyan, yellow and magenta inks. As understood from the arrangement of the nozzles, when the carriage 20 moves in one direction, the cyan, yellow and magenta inks are overlaid in this order, while the carriage moves in the opposite direction, the magenta, yellow and cyan inks are overlaid in this order. Depending on the overlaid order, the resultant colors are slightly different. Therefore, in order to avoid the difference of color tone due to the overlaid order of the color inks, when the printing is performed in the color-mixing print mode, the one-directional print is performed. That is, the inks are ejected when the carriage 20 moves in a predetermined direction, and the inks are not ejected when the carriage 20 moves in the opposite direction. Corresponding to this control, when the first and second patterns P1 and P2 are formed to examine the inclination of the print head (i.e., the nozzle arrays), it may be preferable to form the same only when the carriage 20 moves in the predetermined direction.

Since the printing operation is performed in the color-mixing print mode, the inks dry relatively fast in comparison with a case where the black ink is used. In addition to the above, since the printing is performed only when the carriage 20 moves in one direction, a time period required for forming the image is longer in comparison with a case where the bi-directional printing is performed, thereby a time period that allows the inks to dry sufficiently, is given.

In the color-mixing print mode, the interlace printing method is employed. Therefore, if there is a shift in the printing positions, in the direction of the carriage movement, before and after the sheet is fed, the overlapped portion of the formed images becomes conspicuous. Further, since each of the nozzle arrays 21A and 21B consists of three blocks of nozzles, color shift may easily occur at the boundaries between the blocks. In order to avoid the above deficiencies, according to the embodiment, a part of each nozzle array is used for performing the color-mixing print. Specifically, a rear end portion 21C, which is the block closest to the portion of the carriage 20 supported by the shaft 22. This configuration (i.e., using a part of each nozzle array) lowers the printing speed in comparison with a case where the entire nozzle array is used. However, the color shift can be well suppressed. It should be noted that the similar control, i.e., using a part of the nozzle array for printing, can be selected also for a color image printing to improve the accuracy of the formed image.

Figure 16:
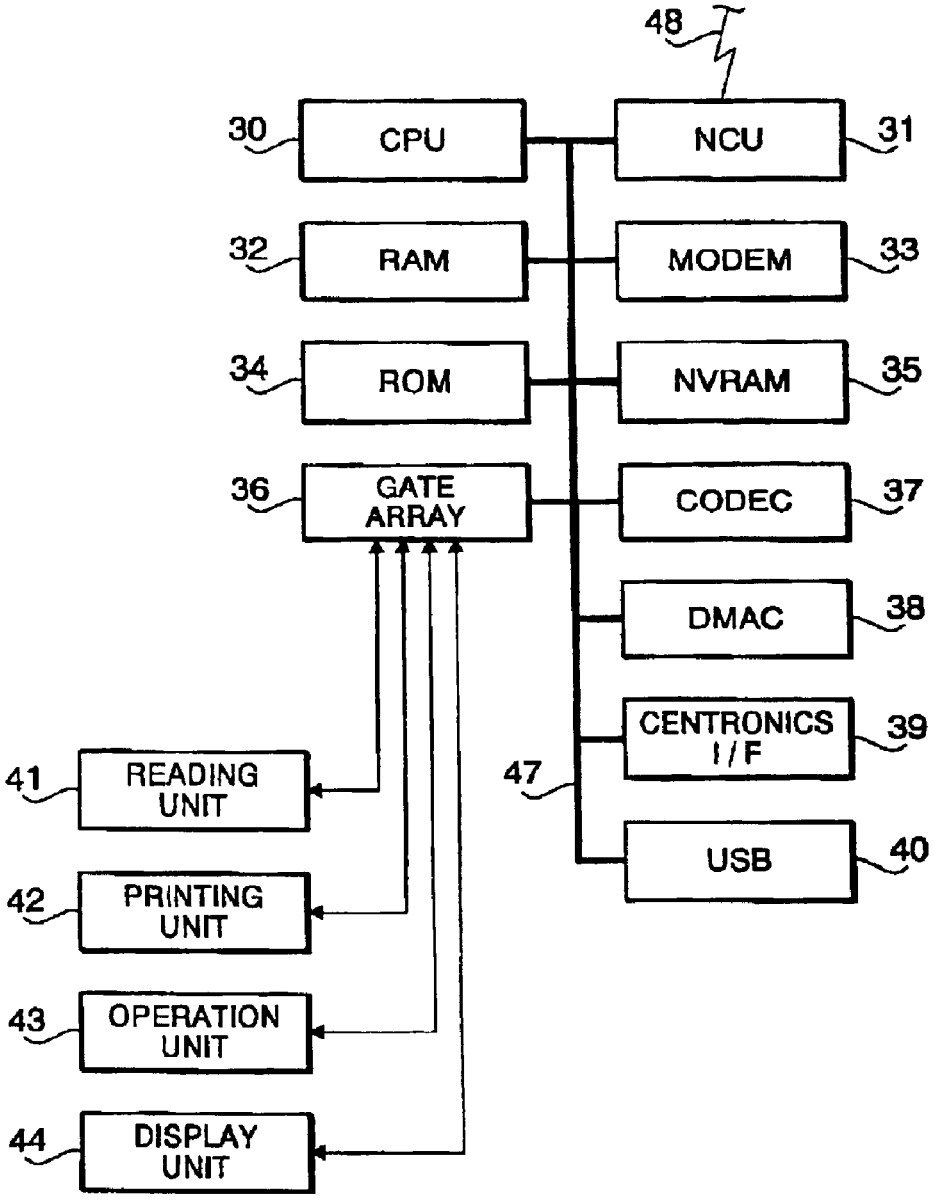
FIG. 16 is a block diagram illustrating an electrical configuration of the facsimile apparatus.

FIG. 16 is a block diagram showing electronic configuration of the facsimile apparatus 100 according to the embodiment.

As shown in FIG. 16, the facsimile apparatus 100 is provided with a CPU 30, an NCU 31, a RAM 32, a modem 33, a ROM 34, an NVRAM (non-volatile memory) 35, a gate array 36, a codec 37, a DMAC 38, a reading unit 41, a printing unit 42, an operation unit 43, a display unit 44. The CPU 30, the NCU 31, the RAM 32, the modem 33, the ROM 34, the NVRAM (non-volatile memory) 35, the gate array 36, the codec 37 and the DMAC 38 are interconnected through a bus 47, which includes address bus, data bus and control signal lines. The reading unit 41, the printing unit 42, the operation unit 43 and the display unit 44 are connected to the gate array 36. The NCU 31 is connected with a public telephone line 48. The facsimile apparatus 100 further includes a centronics interface which is an interface used for connecting the facsimile apparatus 100 with an external device such as a personal computer when the facsimile device 100 is used as a printer. Alternatively or optionally, the facsimile device can be connected with an external device through a USB (Universal Serial Bus) when used as a peripheral device (e.g., a printer or scanner).

The CPU 30 controls the entire operation of the facsimile apparatus 100. The NCU 31 controls a connection through the public telephone line 48. The modem 33 performs modulation/demodulation of facsimile data to be sent/received through the public telephone line 48. The ROM 34 stores programs to be performed by the CPU 30. The NVRAM 35 is used for storing various data. The gate array 36 functions as an interface between the CPU 30 and the units 41–44. The codec 37 performs encoding/decoding the facsimile data or the like. The DMAC 38 mainly performs reading/writing data with respect to the RAM 32.

The reading unit 41 includes a scanner, which scans an image on an original under control of the CPU 30. The printing unit 42 includes an inkjet printer, which performs the printing operations described above under control of the CPU 30. The operation unit 43 is provided with a numeric keypad, and various other operation keys for inputting a user's operation to the CPU 30. The display unit 44 includes, for example, an LCD, which displays various pieces of information.

The operation of the facsimile apparatus 100 will be schematically described with reference to FIG. 18, which is a flowchart illustrating a Print Position Examination procedure.

Figure 18:
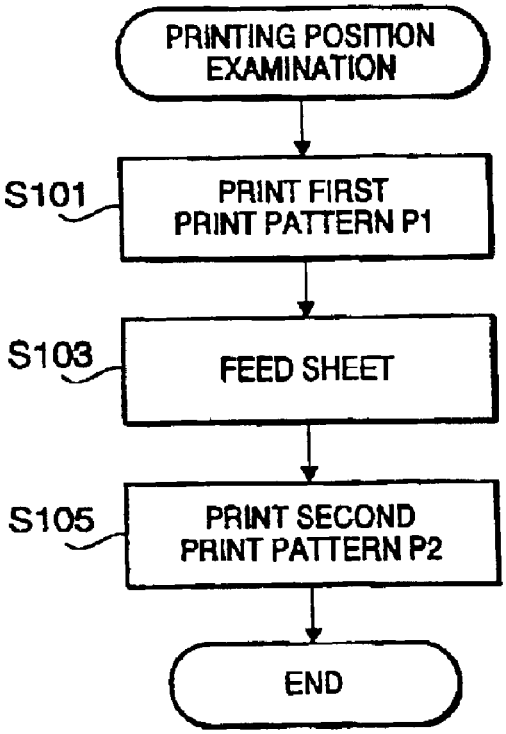
FIG. 18 is a flowchart illustrating a printing position examination procedure.

The CPU 30 performs the Print Position Examination procedure shown in FIG. 18 when the operation in the print position adjustment mode is instructed through the operation unit 43. The CPU 30 controls the carriage 20 to move at a constant speed and controls the print head 21 such that only an upstream portion of the nozzles eject the inks to form a first print pattern P1 on the sheet P (S101). Then, the CPU 30 feeds the sheet P by a predetermined amount, which is less than the length (in the sheet feed direction) of the first pattern P1 (S103). Thereafter, the CPU 30 controls the carriage 20 to move at a constant speed and controls the print head 21 such that only a downstream side portion of the nozzles eject the inks to form a second print pattern P2 on the sheet P (S105). It should be noted that, as aforementioned, the second print pattern P2 may be formed when the carriage 20 moves in the opposite direction with respect to the direction thereof when the first print pattern P1 was formed. Alternatively, the second print pattern P2 may be formed when the carriage 20, moves in the same direction as the direction when the first print pattern P1 was formed.

When the color-mixing print mode is selected, the CPU 30 controls the print head 21 such that the color inks are ejected to the sheet P only when the carriage 20 moves in a predetermined direction.

Further, when the color-mixing print mode is selected, the CPU 30 controls the carriage 20 to move at a constant speed, and controls the print head 21 such that a part of the print head 21 (i.e., the rear portion 21C in the embodiment) contributes to the printing operation.

It should be noted that the above-described control performed by the CPU 30 is stored as a program and stored in the ROM 34.

Figure 17:
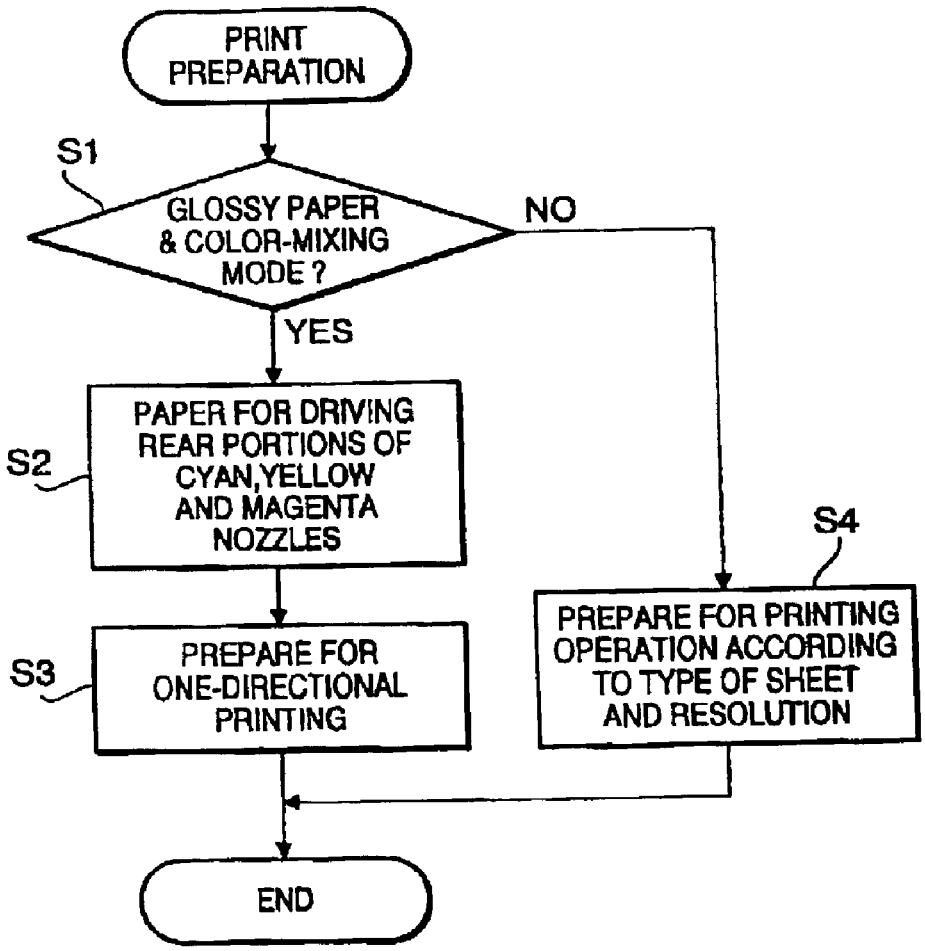
FIG. 17 is a flowchart illustrating a print preparation procedure.

FIG. 17 is a flowchart illustrating a print preparation procedure according to the embodiment.

The procedure is stored as a program in the ROM 34 and performed by the CPU 30.

In S1, control determines whether the glossy paper is employed, and the color-mixing print mode is selected. If the glossy paper is employed (S1: YES), the CPU 30 operates such that only the rear side portion 21C of the cyan, yellow and magenta nozzles will be used for printing (S2).

Selection of recording sheet (i.e., glossy paper or normal paper) may be performed by a user by operating a key on the operation unit 43, or may be set by a personal computer or the like and directly transmitted to the CPU 30. Alternatively, control may select the color-mixing print mode if the glossy paper is to be used. Whether the glossy paper is use or not may be automatically detected using an optical sensor or the like, and the print mode may be automatically selected depending on the detection of the type of the recording sheet.

In S3, the CPU 30 prepares for the one-directional printing operation. After the preparation is finished, the CPU 30 starts the printing operation according to the prepared condition.

If the color-mixing print mode is not selected (S1: NO), the CPU 30 set the printing condition depending on the type of a recording sheet and/or print resolution (S4). Then, the CPU 30 performs the printing operation in accordance with the prepared printing condition.

According to the facsimile apparatus 100 including the inkjet printer described above, when the print position is adjusted, the first pattern P1 is printed using the upstream side portion 21C of the nozzle arrays 21A and 21B, and the second pattern P2 is printed using the downstream side portion 21D of the nozzle arrays 21A and 21B, a part of the second pattern P2 overlaps the first pattern P1. By visually monitoring the overlapped portion of the patterns P1 and P2, it is possible to determine whether the print positions are shifted or not. That is, by monitoring the overlapped portion of the patterns P1 and P2, it becomes possible to know whether the print head 21 is inclined with respect to the sheet feed direction.

If the print head 21 is inclined with respect to the sheet feed direction, by operating the adjustment lever 26, the inclination of the print head 21 is compensated. As a result, the shift between the first and second patterns P1 and P2 is cancelled. Therefore, image quality is improved.

If printing is performed on the glossy paper on which the black ink does not dry well, and the color-mixing print mode is selected, the one direction print is performed, and the color inks of cyan, yellow and magenta are ejected from the print head 21 instead of the black ink. Since one-directional print mode is employed, the three color inks are overlaid in the same order. Accordingly, the image has an even color tone. Further, as the three color inks are overlaid, the amount of ink is relatively great in comparison with a case where the black ink is used. However, since the one-directional print is performed, the time period required for printing the entire image is relatively long in the one-directional print mode in comparison with a case where the bi-directional print is performed. Therefore, even if the one-directional print is performed on the glossy paper, the inks dry well.

Further, when the color-mixing print mode is selected, a part of the nozzle arrays 21A and 21B is used. Therefore, the effect of the inclination of the print head 21 is well suppressed. Accordingly, when the interlace printing is performed and a part of image segment previously formed and a part of image segment currently formed overlap, a high-quality image without color shift can be obtained.

It should not be stressed that the present invention is not limited to the configuration described above, and various modification can be realized.

For example, in the embodiment, the inkjet printer is described as one implemented in a facsimile apparatus. However, the present invention can be applied to a stand along inkjet printer. The invention can also be applied not only to an inkjet printer but to a dot-impact printer, or the like.

In the preferred embodiment, when the color-mixing mode is selected, the one-directional print performed and only a part of the each of the nozzle arrays 21A and 21B is used for printing. Alternatively, the entire nozzle may be used when the one-directional print is performed. Further alternatively, the invention is modified such that, even when the bi-directional print is performed, the only apart of the nozzle array may be used for printing.

Further alternatively, the part of the nozzle array may be used only when the image quality is not improved by operating the adjustment lever 26. If the image quality is not improved even through the printing is performed using the rear portion of the nozzle arrays are used, the number of nozzles used for printing may be limited further. In such a case, the number of the nozzles to be used may be set by a user through the operation unit 48.

Instead of using the adjustment lever 26, the effect of the inclination of the print head 21 may be cancelled by changing driving timings of each nozzle so that the first and second patterns P1 and P2 completely overlap in the carriage moving direction. In such a case, a data storage may be provided in the NVRAM 35 for storing data corresponding the driving timing of the nozzles. The data may be input through the operation unit 48.

The present disclosure relates to the subject matter contained in Japanese Patent Application No. 2001-252198, filed on Aug. 23, 2001, which is expressly incorporated herein by reference in its entirety.

What is claimed is:

1. A printing device that prints an image on a recording sheet, comprising:

a sheet feeding mechanism that feeds said recording sheet by a predetermined amount at a time;

a carriage that is movable, substantially at a constant speed, in a direction substantially perpendicular to a sheet feeding direction;

a print head mounted on said carriage, said print head capable of simultaneously forming a plurality of print lines when said carriage moves;

a controller that controls operations of said sheet feeding mechanism, said carriage and said print head, wherein said controller controls said print head to print a first print pattern that is formed by a part of said plurality of print lines which are on an upstream side with respect to the sheet feed direction, wherein said controller controls said sheet feeding mechanism to feed said recording sheet after said first pattern is formed, wherein said controller controls said print head to print a second print pattern that is formed by a part of said plurality of print lines which are on a downstream side with respect to the sheet feed direction after the recording sheet is fed by said predetermined amount in such a manner that at least a part of the first print pattern overlaps a part of the second print pattern, having a predetermined positional relationship with the part of the second print pattern with respect to a direction perpendicular to the sheet feed direction, wherein the part of the second print pattern deviates from the predetermined positional relationship with respect to a direction perpendicular to the sheet feed direction when the print head is inclined with respect to the sheet feed direction.

2. The printing device according to claim 1, further includes a position changing system that is capable of changing a positional relationship between the first pattern and the second pattern.

3. The printing device according to claim 2, wherein said position changing system mechanically changes the positional relationship between the first pattern and the second pattern.

4. The printing device according to claim 3, wherein said position changing system changes the positional relationship between the first pattern and the second pattern by changing a positional relationship between said print head and said carriage.

5. The printing device according to claim 4, wherein said position changing system changes the positional relationship between said print head and said carriage by moving one side of said print head with respect to said carriage.

6. The printing device according to claim 5, wherein said position changing system has a cam and moves one side of said print head with respect to said carriage by rotating said cam.

7. The printing device according to claim 6, wherein said position changing system has a lever integrally formed with said cain and rotates said cam by rotating said lever.

8. The printing device according to claim 2, wherein said position changing system electrically changes the positional relationship between the first pattern and the second pattern.

9. The printing device according to claim 1, wherein moving directions of said carriage when the first pattern and second pattern are formed are the same.

10. The printing device according to claim 1, wherein moving directions of said carriage when the first pattern and second pattern are formed are opposite.

11. An inkjet printer that prints an image on a recording sheet, comprising:

a sheet feeding mechanism that feeds said recording sheet by a predetermined amount at a time;

a carriage that is movable, substantially at a constant speed, in a direction substantially perpendicular to a sheet feeding direction;

a print head mounted on said carriage, said print head having a plurality of arrays of ink ejecting nozzles, each of said plurality of arrays extending in a direction substantially parallel with a sheet feeding direction;

a controller that controls operations of said sheet feeding mechanism, said carriage and said print head, wherein said controller controls said print head to print a first print pattern using upstream ones of each of said arrays of ink ejecting nozzles, wherein said controller controls said sheet feeding mechanism to feed said recording sheet after said first pattern is formed, wherein said controller controls said print head to print a second print pattern using a downstream side ones of each of said arrays of ink ejecting nozzles in such a manner that at least a part of the first print pattern overlaps a part of the second print pattern, having a predetermined positional relationship with the part of the second print pattern with respect to a direction perpendicular to the sheet feed direction, wherein the part of the second print pattern deviates from the predetermined positional relationship with respect to a direction perpendicular to the sheet feed direction when the print head is inclined with respect to the sheet feed direction.

12. The inkjet printer according to claim 11, further includes a mechanism that changes an inclination of said arrays with respect to the sheet feed direction.

13. The inkjet printer according to claim 12, wherein said mechanism changes the inclination of said arrays with respect to the sheet feed direction by changing a positional relationship between said print head and said carriage.

14. The inkjet printer according to claim 13, wherein said mechanism changes the positional relationship between said print head and said carriage by moving one side of said print head with respect to said carriage.

15. The inkjet printer according to claim 14, wherein said position changing system has a cam and moves one side of said print head with respect to said carriage by rotating said cam.

16. The inkjet printer according to claim 15, wherein said position changing system has a lever integrally formed with said cam and rotates said cam by rotating said lever.

17. A method of examining an image quality of a printing device that prints an image on a recording sheet, the printing device including a sheet feeding mechanism that feeds the recording sheet by a predetermined amount at a time, a carriage that is movable, substantially at a constant speed, in a direction substantially perpendicular to a sheet feeding direction, a print head mounted on the carriage, the print head capable of forming a plurality of print line when the carriage moves, the method comprising:

printing a first print pattern that is formed by a part of the plurality of print lines which are on an upstream side with respect to the sheet feed direction;

feeding the recording sheet after the first pattern is formed; and printing a second print pattern that is formed by a part of the plurality of print lines which are on a downstream side with respect to the sheet feed direction after the recording sheet is fed by the predetermined amount in such a manner that at least a part of the first print pattern overlaps a part of the second print pattern, having a predetermined positional relationship with the part of the second print pattern with respect to a direction perpendicular to the sheet feed direction, wherein the part of the second print pattern deviates from the predetermined positional relationship with respect to a direction perpendicular to the sheet feed direction when the print head is inclined with respect to the sheet feed direction.

18. A printing device that prints an image on a recording sheet, comprising:

a sheet feeding mechanism that feeds said recording sheet by a predetermined amount at a time;

a carriage that is movable, substantially at a constant speed, in a direction substantially perpendicular to a sheet feeding direction;

a print head mounted on said carriage, said print head having a plurality of arrays of printing elements, each of said plurality of arrays extending in a direction substantially parallel with a sheet feed direction, said print head capable of simultaneously forming a plurality of print lines arranged in the sheet feed direction using said printing elements when said carriage moves;

a positional changing system that is capable of changing the positional relationship between said print head and said carriage by moving one side of said print head with respect to said carriage in such a manner that inclination of said arrays of printing elements with respect to said sheet feeding direction is varied; and a controller that controls operations of said sheet feeding mechanism, said carriage and said print head, wherein said controller controls said print head to print a first print pattern that is formed by a part of said plurality of print lines arranged in the sheet feed direction, the part being a plurality of print lines which are on an upstream side with respect to the sheet feed direction, wherein said controller controls said sheet feeding mechanism to feed said recording sheet after said first pattern is formed, wherein said controller controls said print head to print a second print pattern that is formed by a part of said plurality of print lines arranged in the sheet feed direction, the part being a plurality of print lines which are on a downstream side with respect to the sheet feed direction after the recording sheet is fed by said predetermined amount, at least a part of the first print pattern overlapping a part of the second print pattern, wherein the positional changing system is capable of changing the positional relationship between the first pattern and the second pattern by changing the positional relationship between the print head and the carriage.

19. The printing device according to claim 18, wherein moving directions of said carriage when the first pattern and second pattern are formed are the same.

20. The printing device according to claim 18, wherein moving directions of said carriage when the first pattern and second pattern are formed are opposite.

21. An inkjet printer that prints an image on a recording sheet, comprising:

a sheet feeding mechanism that feeds said recording sheet by a predetermined amount at a time;

a carriage that is movable, substantially at a constant speed, in a direction substantially perpendicular to a sheet feeding direction;

a print head mounted on said carriage, said print head having a plurality of arrays of ink ejecting nozzles, each of said plurality of arrays extending in a direction substantially parallel with a sheet feeding direction;

a positional changing system that is capable of changing the positional relationship between said print head and said carriage by moving one side of said print head with respect to said carriage in such a manner that inclination of said arrays of ink ejecting nozzles with respect to said sheet feeding direction is varied; and a controller that controls operations of said sheet feeding mechanism, said carriage and said print head, wherein said controller controls said print head to print a first print pattern that is formed by a plurality of print lines arranged in the sheet feed direction, the plurality of print lines being on an upstream side with respect to the sheet feed direction, using upstream ones of each of said arrays of ink ejecting nozzles, wherein said controller controls said sheet feeding mechanism to feed said recording sheet after said first pattern is formed, wherein said controller controls said print head to print a second print pattern that is formed by a plurality of print lines arranged in the sheet feed direction, the plurality of print lines being on a downstream side with respect to the sheet feed direction, using a downstream side ones of each of said arrays of ink ejecting nozzles, at least a part of the first print pattern overlapping a part of the second print pattern, wherein the positional changing system is capable of changing the positional relationship between the first pattern and the second pattern by changing the positional relationship between the print head and the carriage.

22. The inkjet printer according to claim 21, wherein said position changing system has a cam and moves one side of said print head with respect to said carriage by rotating said cam.

23. The inkjet printer according to claim 22, wherein said position changing system has a lever integrally formed with said cam and rotates said cam by rotating said lever.

24. A method of improving an image quality of a printing device that prints an image on a recording sheet, the printing device including a sheet feeding mechanism that feeds the recording sheet by a predetermined amount at a time, a carriage that is movable, substantially at a constant speed, in a direction substantially perpendicular to a sheet feeding direction, a print head mounted on the carriage, the print head having a plurality of arrays of printing elements, each of said plurality of arrays extending in a direction substantially parallel with a sheet feed direction, the print head capable of forming a plurality of print lines arranged in the sheet feed direction using said printing elements when the carriage moves, the method comprising:

printing a first print pattern that is formed by a part of the plurality of print lines arranged in the sheet feed direction, the part being a plurality of print lines which are on an upstream side with respect to the sheet feed direction;

feeding the recording sheet after the first pattern is formed; and printing a second print pattern that is formed by a part of the plurality of print lines arranged in the sheet feed direction, the part being a plurality of print lines which are on a downstream side with respect to the sheet feed direction after the recording sheet is fed by the predetermined amount, at least a part of the first print pattern overlapping a part of the second print pattern, changing the positional relationship between the first pattern and the second pattern by moving one side of the print head with respect to the carriage in such a manner that inclination of the arrays of printing elements with respect to the sheet feeding direction is varied.

25. The printing device according to claim 24, wherein said position changing system has a cam and moves one side of said print head with respect to said carriage by rotating said cam.

26. The printing device according to claim 25, wherein said position changing system has a lever integrally formed with said cam and rotates said cam by rotating said lever.

* * * * *